US006236010B1

(12) United States Patent
Rostron

(10) Patent No.: US 6,236,010 B1
(45) Date of Patent: May 22, 2001

(54) CIRCUIT INTERRUPTER INCLUDING A PENETRATING ELECTRICAL CONTACT WITH GRIP AND RELEASE STRUCTURE

(75) Inventor: Joseph R. Rostron, McDonough, GA (US)

(73) Assignee: Southern States, Inc., Hampton, GA (US)

( * ) Notice: Subject to any disclaimer, the term of this patent is extended or adjusted under 35 U.S.C. 154(b) by 0 days.

(21) Appl. No.: 09/448,347

(22) Filed: Nov. 23, 1999

Related U.S. Application Data

(60) Provisional application No. 60/143,837, filed on Jul. 14, 1999.

(51) Int. Cl.[7] ..... H01H 33/02; H01H 1/06; H01R 13/02

(52) U.S. Cl. ..... 218/146; 200/275; 218/65; 439/733.1

(58) Field of Search ..... 200/275; 218/7, 218/12, 14, 13, 16–21, 30–33, 43–84, 143–145, 146; 439/733.1–752

(56) References Cited

U.S. PATENT DOCUMENTS

| | | | | |
|---|---|---|---|---|
| 1,022,619 | | 4/1912 | Burke | 200/48 R |
| 1,177,841 | | 4/1916 | Young | 361/131 |
| 1,389,623 | | 9/1921 | Calloway | 361/131 |
| 1,453,774 | | 5/1923 | Van Etten | 361/131 |
| 1,700,853 | | 2/1929 | Randall et al. | 361/131 |
| 1,867,293 | * | 7/1932 | Wedmore et al. | 218/147 |
| 2,106,114 | | 1/1938 | Crabbs | 218/12 |
| 2,172,225 | | 9/1939 | Schofield et al. | 218/12 |
| 2,200,122 | | 5/1940 | Rawlins | 218/12 |
| 2,297,818 | | 10/1942 | Van Sickle | 218/83 |
| 2,601,138 | | 6/1952 | Hart | 218/12 |
| 2,697,153 | | 12/1954 | Owens et al. | 218/12 |
| 2,897,323 | | 7/1959 | Krase et al. | 218/12 |
| 2,905,794 | | 9/1959 | Upton, Jr. | 218/8 |
| 2,942,085 | | 6/1960 | Leeds | 218/4 |
| 2,955,181 | | 10/1960 | Luehring | 218/10 |
| 3,026,395 | | 3/1962 | Howell et al. | 218/12 |
| 3,032,632 | | 5/1962 | Beach et al. | 218/84 |
| 3,117,192 | | 1/1964 | Owens | 200/48 R |
| 3,168,681 | | 2/1965 | Wilson | 361/118 |
| 3,566,055 | | 2/1971 | Weston | 200/48 R |

(List continued on next page.)

FOREIGN PATENT DOCUMENTS

| | | |
|---|---|---|
| 710925 | 6/1954 | (GB) . |
| 3-134926 | 7/1991 | (JP) . |

*Primary Examiner*—J. R. Scott
(74) *Attorney, Agent, or Firm*—Gardner Groff Mehrman & Josephic, P.C.

(57) ABSTRACT

A penetrating contact design that decreases the time needed to move the male and female contacts of a circuit interrupter from a closed circuit position to an open circuit position. The penetrating contact has a grip-enhancing member that can be located on either the male or female contact. The grip-enhancing member of the penetrating contact maintains physical contact between a male contact and a female contact, while the penetrating contact is in the closed circuit condition. The grip-enhancing member creates a relatively high resistance to separation of the male and female contacts. This separation resistance enhances the separation acceleration of the male and female when they are separated by the circuit interrupter. When an operator initiates a disconnect procedure, this separation resistance will maintain the male contact and female contact in the closed circuit position for a longer time as the interrupter's separation mechanism is energized. This operation results in the generation of a higher potential energy in the separation mechanism prior to movement of the male contact with respect to the female contact. When the separation resistance is overcome and separation of the contacts occurs, a higher separation acceleration will result from the higher potential energy in the separation mechanism.

19 Claims, 6 Drawing Sheets

U.S. PATENT DOCUMENTS

| | | | | |
|---|---|---|---|---|
| 3,777,218 | | 12/1973 | Kessler | 361/131 |
| 3,881,138 | | 4/1975 | Luxa et al. | 361/131 |
| 3,881,766 | | 5/1975 | Pratsch | 361/115 |
| 3,891,897 | | 6/1975 | Jakszt | 361/120 |
| 4,110,580 | | 8/1978 | Farish | 218/85 |
| 4,139,751 | * | 2/1979 | Rostron et al. | 218/65 |
| 4,339,641 | | 7/1982 | Noeske | 218/64 |
| 4,460,937 | | 7/1984 | Kamata et al. | 361/604 |
| 4,468,716 | | 8/1984 | Kamata et al. | 361/604 |
| 4,479,165 | | 10/1984 | Kamata et al. | 361/618 |
| 4,492,835 | | 1/1985 | Turner | 218/5 |
| 4,502,132 | | 2/1985 | Nishikawa et al. | 361/601 |
| 4,541,033 | | 9/1985 | Saito | 361/602 |
| 4,780,958 | * | 11/1988 | Shaffer | 29/874 |
| 5,124,872 | | 6/1992 | Pham et al. | 361/11 |
| 5,164,559 | | 11/1992 | Pham et al. | 218/143 |
| 5,170,023 | | 12/1992 | Pham et al. | 218/143 |
| 5,235,147 | | 8/1993 | Pham et al. | 218/144 |
| 5,241,294 | | 8/1993 | Pham et al. | 338/21 |
| 5,262,605 | | 11/1993 | Pham et al. | 218/143 |
| 5,264,671 | | 11/1993 | Pham et al. | 218/144 |
| 5,266,758 | | 11/1993 | Pham et al. | 218/144 |
| 5,302,784 | | 4/1994 | Perret | 218/143 |
| 5,304,760 | | 4/1994 | Pham et al. | 218/143 |
| 5,897,401 | * | 4/1999 | Fili et al. | 439/733.1 |

* cited by examiner

CIRCUIT INTERRUPTER INCLUDING A PENETRATING ELECTRICAL CONTACT WITH GRIP AND RELEASE STRUCTURE

REFERENCE TO RELATED APPLICATION

This application claims priority to commonly-owned U.S. Provisional Patent Application No. 60/143,837, filed Jul. 14, 1999.

TECHNICAL FIELD

The present invention relates to electrical circuit interrupters and more particularly relates to a two-tiered penetrating electrical contact that reduces the probability of a restrike by increasing the velocity of contact separation.

BACKGROUND OF THE INVENTION

Circuit interrupters may be used as disconnecting switches for positively disconnecting an electrical power transmission line from a source of power. Disconnection is often required to enable maintenance work to be performed on the transmission line or on an electrical apparatus connected to the transmission line. Interrupters typically have two contacts that are in physical contact with one another when the transmission line is connected to the power source and are not in physical contact when the transmission line is disconnected from the power source. The interrupter is said to be in the closed circuit position when the contacts are in contact and in the open circuit position when the contacts are not in contact. Because one of the interrupter's contacts typically fits into the other contact in the closed circuit condition, the contacts are usually referred to as "penetrating contacts," including separable male and female contacts. Specifically, a conventional set of penetrating contacts includes a pin contact (male) and a tulip contact (female).

Typically, electric power transmission and distribution lines that carry high voltage and/or high current must be disconnected quickly in order to avoid a restrike. Restrikes occur when the interrupter's contacts are not connected, but are still close enough to each other to permit current to be conducted through the air (or other media) between the contacts. When the contacts of a properly designed penetrating contact are fully separated, the distance between the contacts is sufficient to prohibit a restrike. However, a restrike can occur as the contacts are moved from the fully connected position to the fully separated position. Likewise, a restrike can occur as the contacts are moved from the fully separated position to the fully connected position.

Circuit interrupt designers seek to minimize restrikes because restrikes can be dangerous to persons operating the interrupter, can cause system disturbances, and can degrade the components of the interrupter. Thus, the separation mechanism of an interrupter must be capable of opening the contacts at a separation velocity sufficient to prevent a restrike of the arc once the initial arc extinction occurs at a current zero. Separation acceleration is typically provided by separation mechanisms such as a spring arrangement in the circuit interrupter. The potential energy stored in a spring-type separation mechanism is used to produce the kinetic energy necessary to provide the desired separation velocity.

Once the circuit is opened, there is a rapid rise in voltage across the contacts known as the "transient recovery voltage." If the contacts are not separated quickly enough for the gap between the contacts (the "arc gap") to withstand this rising voltage, then the gap breaks down and the resulting current flow results in a restrike. Restrikes generally occur at or near the point when the transient recovery voltage reaches its maximum value. Thus, to prevent a restrike, the contacts must be moved from the fully connected position to a position at which a restrike is impossible within a period that is less than the time it takes the voltage to reach its maximum value.

Thus, it is a goal of interrupt designers to design an interrupt with a separation mechanism that can store sufficient potential energy prior to contact separation to provide a separation acceleration sufficient to prevent a restrike. However, cost is another design constraint and feasible separation mechanisms must be limited to those that will provide an acceptable separation acceleration, but are cost effective.

Conventional penetrating contacts used in interrupters include models providing a high degree of resistance to separation (e.g., static friction) between the male and female contacts when the contacts are in a closed circuit position. Penetrating contacts of this design permit the separation mechanism to store additional potential energy prior to separating the contacts, because the contacts are held in the closed circuit position by the high degree of separation resistance. The additional potential energy helps to generate a separation acceleration suitable for minimizing restrikes. Unfortunately, available contacts of this kind generate a dynamic drag as the contacts accelerate toward separation which effectively reduces the separation acceleration, thus increasing the chances of generating a restrike following separation.

Another kind of penetrating contact arrangement does not create a high degree of separation resistance. However, with contacts of this type, the separation mechanism must generate a relatively high energy level to produce an acceptable separation acceleration. Such separation mechanisms tend to have complex designs and are expensive to manufacture and maintain.

Non-penetrating contacts could also be used in circuit interrupters with spring-type separation mechanisms in order to reduce dynamic drag. However, non-penetrating interrupters do not provide sufficient resistance suitable for increasing the potential energy stored in the separation mechanism. Thus, the separation mechanism must produce the separation acceleration without the assistance of the separation resistance between the contacts. Such separation mechanisms are typically more expensive than those used with penetrating contacts. Often the increased cost of this kind of separation mechanism renders the interrupter design prohibitively expensive.

Sacrificial "butt" contacts have also been used in circuit interrupters as non-penetrating contacts. Sacrificial contacts are designed to deteriorate over time. Thus, there is no need for high speed contact separation, when sacrificial contacts are used in an interrupter. While this reduces the cost of the separation mechanism, the deterioration of the contacts reduces the conduction characteristics of the contacts and requires regular maintenance to monitor and replace the contacts as they deteriorate.

Therefore, there is a need for an interrupter that provides a high separation acceleration to minimize restrikes and contact deterioration. More particularly, there is a need for electrical contacts that can be implemented in an interrupter to provide for increased contact separation acceleration without increasing the required force of the separation mechanism. The contacts should have a simple structure and be inexpensive to manufacture.

SUMMARY OF THE INVENTION

The penetrating contacts of the present invention solve the problems of the prior art contacts by providing a pin contact having a two-tiered structure that provides a gripping portion having a high degree of resistance to separation as well as an elongate shaft portion having a reduced degree of resistance to separation. This two-tiered structure permits storage of potential energy in the separation mechanism while the contacts are in the closed circuit position. The two-tiered structure also reduces dynamic drag as the contacts are accelerated toward the open circuit position (i.e., the "opening stroke"). The two-tiered structure includes a pin contact having a gripping portion and an elongate shaft portion that penetrates into a tulip contact. The gripping portion has a grip-enhancing element that provides resistance to separation of the pin and tulip contacts. The tulip contact grips the gripping portion in the closed circuit position, but permits the elongate shaft portion to slide relatively freely as the interrupter transitions to the open circuit position.

This novel structure is advantageous because it provides a gripping portion that permits the generation of a high degree of potential energy in the separation mechanism without hampering the separation acceleration. Moreover, the elongate shaft portion of the pin contact maintains full electrical contact (i.e., maintains electrical conduction) and reduced physical contact, so that the separation mechanism can reach a high separation acceleration prior to the electrical separation of the contacts and after an arc gap has formed between the contacts. Because the elongate shaft portion has a reduced diameter, the kinetic friction between the elongate shaft portion and the tulip contact is relatively low, such that the separation acceleration is not significantly reduced.

In one aspect of the present invention, a male contact is in removable engagement with a female contact. The male contact has a gripping portion including a grip-enhancing element operative to create a high degree of tension with the female contact when the gripping portion is in contact with a receiver portion of the female contact. The male contact also has an elongate shaft portion connected to the gripping portion and having a low degree of tension with the receiver of the female contact when the elongate shaft portion is adjacent to the receiver. The receiver establishes physical and electrical contact between the female contact and the gripping and elongate shaft portions of the male contact. The gripping portion and the elongate shaft portion of the male contact are configured to maintain electrical conduction with the receiver when the male and female contacts are energized within an intended high voltage range. The electrical conduction is maintained as the male and female contacts slide past each other in an opening stroke, until the male and female contacts define an arc gap. The male and female contacts are configured to extinguish the electrical conduction at the arc gap during the opening stroke, by increasing the separation resistance and the separation acceleration. The male and female contacts are also configured to extinguish the electrical conduction for multiple opening strokes without substantial physical degradation.

The present invention provides a pin contact design that decreases the time needed to move the contacts from the fully connected position to the fully separated position by increasing the separation acceleration. The pin contact has a multiple diameter structure. The largest diameter of the pin contact is in physical contact with the spring contactors of the tulip contact while the interrupter is in the closed circuit position. The physical contact point between the spring contactors and the largest diameter portion of the pin is characterized by having a high coefficient of friction. This high coefficient of friction is created by the spring contacts being stressed apart by the pin contact's largest diameter portion and biased toward the pin contact.

The present invention is well adapted for use with a puffer-type circuit interrupter. A puffer-type circuit interrupter typically disconnects a transmission line from a power source such that any resulting restrike is minimized by an arc-extinguishing gas, such as an admixture of helium gas and sulphur-hexaflouride ($SF_6$) gas. In a puffer-type interrupter, a plunger arrangement is typically utilized to connect and disconnect the circuit by bringing a pin contact and a tulip contact into and out of physical contact with each other. In this kind of puffer-type interrupter, gas flow may be achieved by the relative motion of the movable contact plunger and a stationary contact structure. The plunger arrangement is confined within a sealed interrupter chamber, such that the movement of the contact plunger with respect to the stationary contact structure and the interrupter chamber controls the flow of the $SF_6$ gas across the arc gap.

In another aspect of the present invention, a pin contact is provided with a raised annular rib around the gripping portion of the pin contact. The tulip contact is provided with spring contactors that slide over the annular ring when the interrupter is transitioned to the closed circuit position. The annular ring, in conjunction with the biased spring contactors, is operative to provide resistance to separation, thereby increasing the ability of the interrupter's separation mechanism to generate potential energy prior to contact separation.

In another aspect of the present invention, a pin contact is provided with an inset annular groove around the gripping portion of the pin contact. The tulip contact is provided with spring contactors that slide into the annular groove when the interrupter is transitioned to the closed circuit position. The annular groove, in conjunction with the biased spring contactors, is operative to provide resistance to separation, thereby increasing the ability of the interrupter's separation mechanism to generate potential energy prior to contact separation.

In still another aspect of the present invention, a pin contact is provided with one or more raised knobs located on the gripping portion of the pin contact. The tulip contact is provided with spring contactors that slide over the one or more raised knobs when the interrupter is transitioned to the closed circuit position. The one or more raised knobs, in conjunction with the biased spring contactors, are operative to provide resistance to separation, thereby increasing the ability of the interrupter's separation mechanism to generate potential energy prior to contact separation.

In another aspect of the present invention, a pin contact is provided with one or more spring-loaded bearings located on the gripping portion of the pin contact. The tulip contact is provided with an annular groove into which the one or more spring-loaded bearings slide when the interrupter is transitioned to the closed circuit position. The one or more spring-loaded bearings, in conjunction with the tulip contact's annular groove, are operative to provide resistance to separation, thereby increasing the ability of the interrupter's separation mechanism to generate potential energy prior to contact separation.

In yet another aspect of the present invention, a pin contact is provided with one or more spring clips located on the gripping portion of the pin contact. The tulip contact is provided with an annular groove into which the one or more spring clips slide when the interrupter is transitioned to the closed circuit position. The one or more spring clips, in conjunction with the tulip contact's annular groove, are operative to provide resistance to separation, thereby increasing the ability of the interrupter's separation mechanism to generate potential energy prior to contact separation.

In view of the foregoing, these and other advantages of the present invention will become apparent from the detailed description and drawings to follow and the appended claim set.

DETAILED DESCRIPTION

Figure 1A:
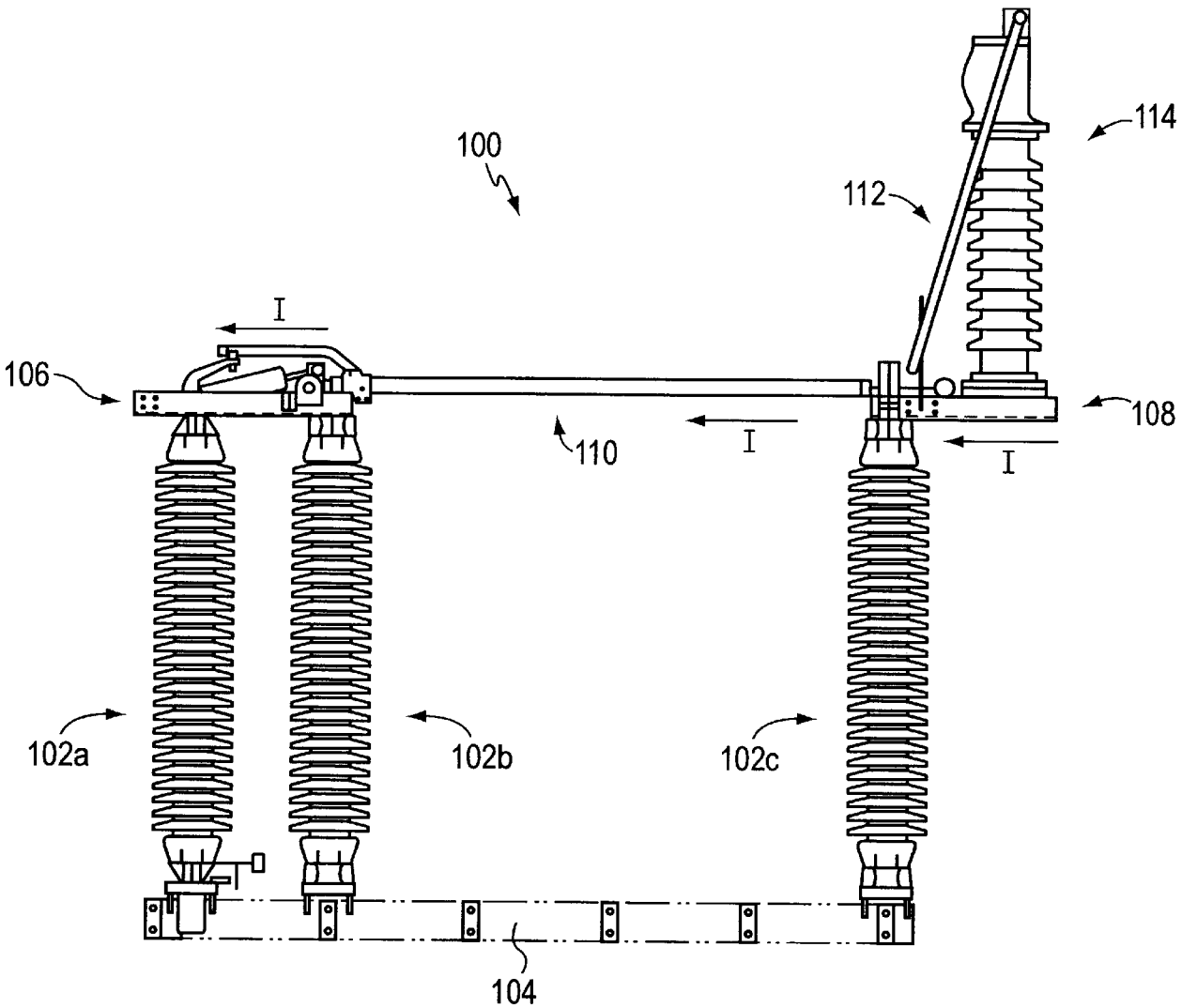
FIG. 1*a* illustrates a puffer-type circuit interrupter in a closed circuit position.

The present invention provides a pin and tulip contact arrangement, wherein the pin is a male electrical contact and the tulip is a female electrical contact. The tulip contact receives the pin contact into the tulip contact's center cavity or "receiver." The tulip contact's receiver has several spring contactors arranged annularly about the tulip contact's longitudinal axis. The spring contactors are biased toward the longitudinal axis of the tulip contact. The spring contactors establish physical and electrical contact between the tulip contact and the pin contact. The spring contactors are spread apart as the pin contact enters the tulip contact the surface of the pin contact meets the surfaces of the spring contactors. As the pin contact protrudes further into the tulip contact, the spring contactors slide along the surface of the pin contact.

The present invention is adapted for use with a puffer-type circuit interrupter, but can be used in any circuit-interrupting apparatus. Generally, a puffer-type circuit interrupter provides a means for disconnecting a transmission line from a power source such that any resulting restrike is minimized by an arc-extinguishing gas such as an admixture of helium gas and sulphur-hexaflouride ($SF_6$) gas. The dielectric $SF_6$ gas is ionized as a restrike is created, absorbing the energy of the restrike. Once the restrike has been extinguished, the ions recombine rapidly to restore the $SF_6$ gas (and its dielectric properties) to its original condition.

In a puffer-type interrupter, a plunger arrangement is typically utilized to close and open the circuit by bringing a pin contact and a tulip contact into and out of physical contact with each other. In this kind of puffer-type interrupter, gas flow may be achieved by the relative motion of the movable contact plunger and a stationary contact structure. The plunger arrangement is confined within a sealed interrupter chamber, such that the movement of the contact plunger with respect to the stationary contact structure and the interrupter chamber controls the flow of the $SF_6$ gas across the arc gap.

One means for minimizing the restrike is to increase the speed at which the tulip and pin contacts are separated. Transmission lines that carry high voltage and/or high current must be disconnected quickly in order to minimize the probability of a restrike. Restrikes occur when the pin and tulip contacts are not actually connected, but are still close enough to each other to permit current to be conducted through the $SF_6$ gas (or other media) between the contacts. When the contacts of a properly designed interrupt are fully separated, the distance between the contacts is sufficient to prohibit a restrike. However, a restrike can occur as the contacts are moved from the fully connected position to the fully separated position, but are still within an "arc gap." The arc gap is the gap that is created as the pin and tulip contacts are physically separated from one another, but are still within a range in which a restrike may occur.

A human interrupter operator is typically incapable of generating enough energy to separate the contacts at the desired velocity. Thus, interrupters generally utilize a separation mechanism such as a spring arrangement to separate the contacts. The spring arrangement enables the contacts to be separated at a velocity greater than that of which a human operator of the interrupter is capable. The human operator initiates a disconnect procedure by turning a lever on the interrupter. As the lever is turned by the operator, a separator spring is energized until it reaches an energy level capable of overcoming the inertia of the stationary interrupter in its connected condition. When this energy level is reached, the potential energy in the spring is converted to kinetic energy and the contacts are moved apart by the spring arrangement.

The present invention provides a penetrating contact design that decreases the time needed to move the male and female contacts of a circuit interrupter from a closed circuit position to an open circuit position. The penetrating contact has a grip-enhancing member that can be located on either the male or female contact. The grip-enhancing member of the penetrating contact maintains physical contact between a male contact and a female contact, while the penetrating contact is in the closed circuit condition. The grip-enhancing member creates a relatively high resistance to separation of the male and female contacts. This separation resistance enhances the separation acceleration of the male and female when they are separated by the circuit interrupter. When an operator initiates a disconnect procedure, this separation resistance will maintain the male contact and female contact in the closed circuit position for a longer time as the interrupter's separation mechanism is energized. This operation results in the generation of a higher potential energy in the separation mechanism prior to movement of the male contact with respect to the female contact. When the separation resistance is overcome and separation of the contacts occurs, a higher separation acceleration will result from the higher potential energy in the separation mechanism.

A Puffer-Type Circuit Interrupter

Referring now to FIG. 1*a,* an exemplary puffer-type circuit interrupter 100 (hereinafter, "interrupter") is illustrated in a closed circuit condition. The interrupter 100 is usually used in the closed circuit position. Only when the circuit must be disconnected is the interrupter 100 moved to the open circuit position. In the interrupter 100 of FIG. 1, the interrupter 100 is implemented with three insulators 102*a*–102*c* that physically and electrically separate the interrupter 100 from a support structure 104.

In its closed position, the interrupter permits current to flow through the interrupter from a power source contact 106 to a transmission line contact 108. The current flows through blade arm 110 and is prevented from flowing to the support structure 104 by insulators 102*a*–102*c*. The arrows marked "I" indicate the current flow through the interrupt in FIGS. 1*a*–*c*.

The disconnect procedure for opening the circuit is actuated by a drive mechanism (not shown) integrated into insulator 102*a*. The human operator initiates the disconnect procedure by means of the drive mechanism. The drive mechanism can be mechanical or electromechanical and generally comprises a lever arm or a motor for turning the drive mechanism, thereby actuating the interrupter 100.

Figure 1B:
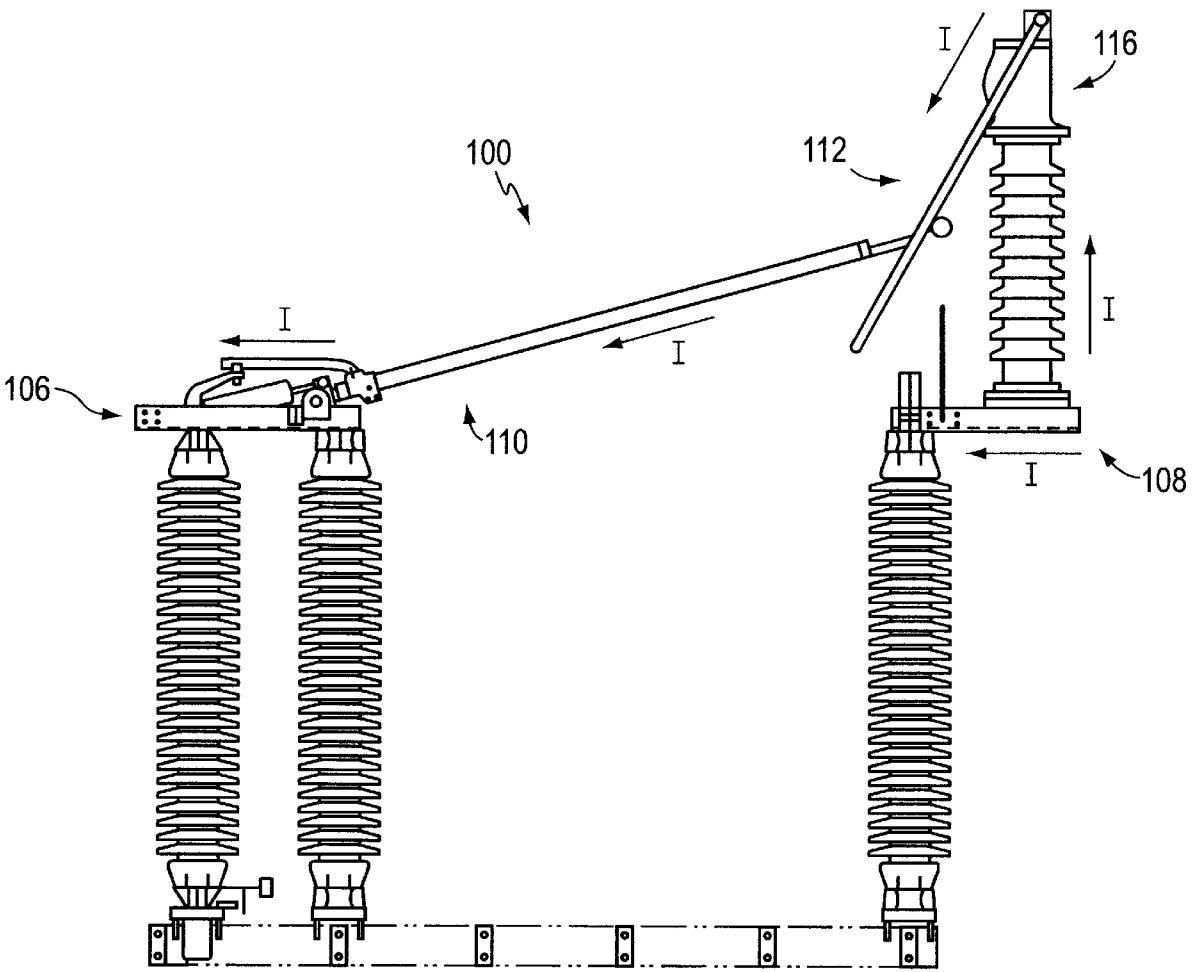
FIG. 1*b* illustrates a puffer-type circuit interrupter as it is moved from a closed circuit position to an open circuit position.

Referring now to FIG. 1*b*, the interrupter is shown as it is moved from a closed circuit position to an open circuit position (i.e., the "opening stroke"). As the drive mechanism actuates the interrupter's 100 disconnect procedure, the blade arm 110 is lifted away from physical contact with the transmission line contact 108. However, electrical contact between the blade arm 110 and the transmission line contact 108 is maintained through the interrupter's 100 actuator arm 112. The actuator arm 112 permits the disconnect procedure to be initiated without interrupting the flow of current between the transmission line contact 108 and the power source contact 106. Rather than interrupting the current flow, the current flow is redirected through the actuator arm 112 and through electrical contacts in the sealed interrupter chamber 114. The contacts in the sealed interrupter chamber 114 will be discussed in more detail below, in connection with FIGS. 2 and 3. The arrows marked "I" illustrate the path of the current flow while the interrupter 100 is being moved from the closed circuit position to the open circuit position.

While the blade arm 110 is still in physical and electrical contact with actuator arm 112, the actuator arm 112 energizes a separation mechanism, such as a spring arrangement (not shown), inside the spring housing 116. The spring housing contains the spring arrangement that provides for the accumulation of potential energy in the form of one or more energized springs. As the blade arm 110 is lifted toward vertical, it eventually raises the actuator arm 112 to a transition position. In the instant following this transition position, the interrupter's spring arrangement separates the contacts within the sealed interrupter chamber and the transmission line contact 108 is electrically disconnected from the power source contact 106. The transition point represents the instant separating the accumulation of potential energy in the spring arrangement and the conversion of the potential energy to kinetic energy by the spring arrangement. This conversion results in the triggering of the interrupter 100 and the opening of the circuit. Alternatively, the separation mechanism could be one of various other devices for separating and re-connecting the contacts at a relatively high velocity. For example, the separation mechanism may utilize a hydraulic, pneumatic or explosive device for separating and re-connecting the contacts.

Many interrupter spring arrangements have been implemented and described in the prior art. A novel interrupter is described and claimed in copending U.S. patent application entitled "Limited Restrike Circuit Interrupter Used as a Line Capacitor and Load Switch" which was filed on Nov. 23, 1999. That co-pending application is assigned to Southern States, Inc., has been assigned Ser. No. 09/448,198, and is hereby incorporated by reference. For the purposes of this discussion, those skilled in the art will appreciate that the interrupter spring arrangement is used to accumulate potential energy, such that when the transition point is reached, potential energy is converted to kinetic energy to separate the interrupter's contacts. By storing potential energy prior to the transition point, the separation acceleration of the interrupter contacts is greater than that which a human operator is capable of generating.

Figure 1C:
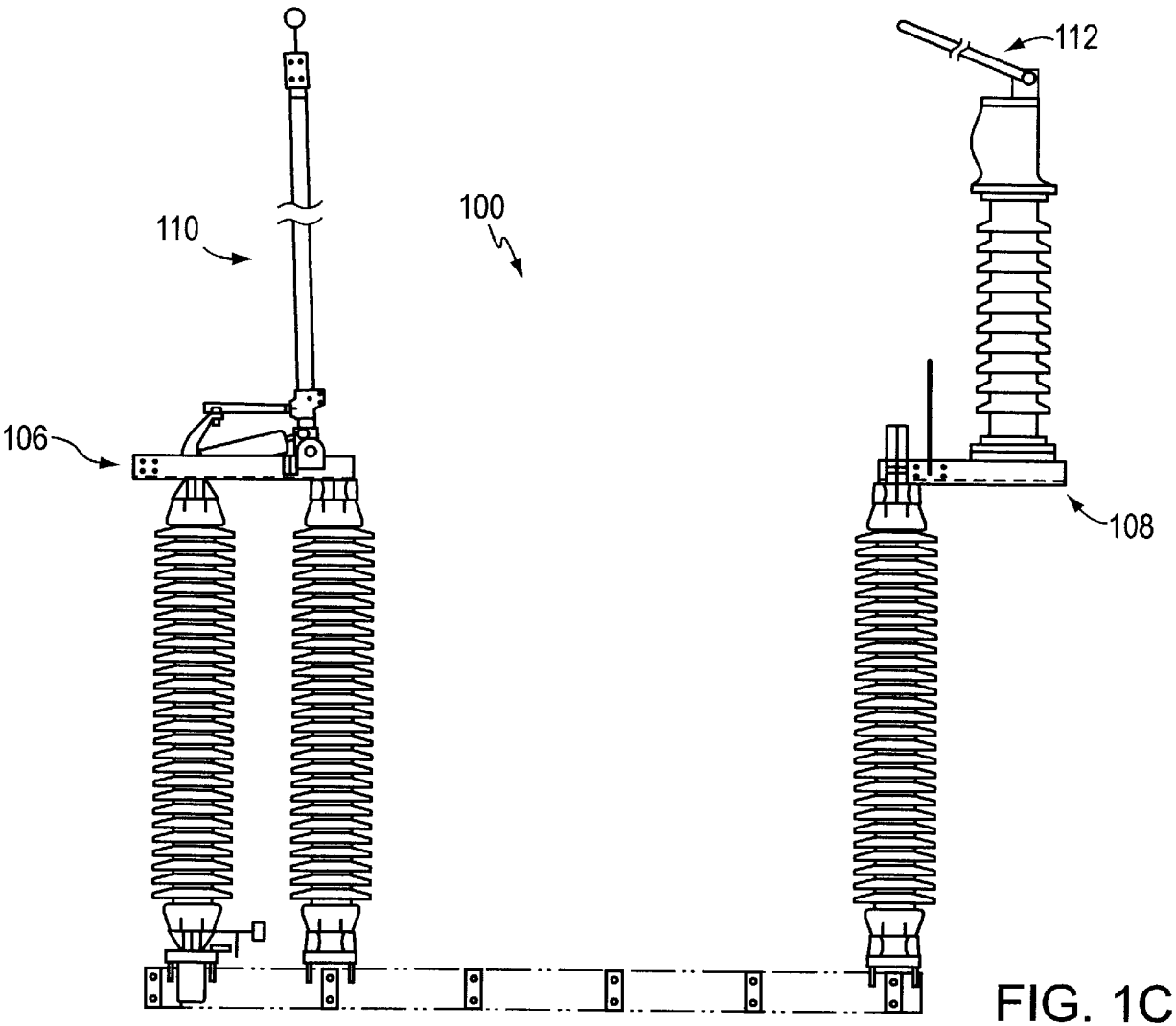
FIG. 1*c* illustrates a puffer-type circuit interrupter in an open circuit position.

Referring now to FIG. 1*c*, the interrupter 100 is shown in its open circuit position. Although the electrical connection between the transmission line contact 108 and the power source contact 106 is disconnected while the blade arm 110 and the actuator arm 112 are still in physical contact, the exemplary interrupter provides for the blade arm 110 to be placed in a vertical position. This vertical position serves as a visible indication to the human operator that the interrupter has completely disconnected the transmission line from the power source. Governmental regulations, municipal codes and/or union rules generally require a particular dimension of physical separation between the electrical contact of the power source and the electrical contact of the transmission line. Therefore, the interrupter 100 of FIG. 1*c* is shown in the open circuit position with the blade arm in a fully vertical position.

The interrupter 100 is also used to electrically connect the transmission line contact 108 and the power source contact 106. The blade arm 110 can be lowered by means of the drive mechanism (not shown) and eventually comes into contact with the actuator arm 112, pushing the actuator arm downward. As the actuator arm 112 is moved downward, it energizes the spring arrangement. A second transition point is reached at which the spring arrangement forces the interrupter's contacts together at a re-connection acceleration. The re-connection acceleration is greater than the acceleration capable of being generated by the human operator via the drive mechanism, but is typically less than the separation acceleration. The re-connection acceleration typically does not need to be as great as the separation acceleration, because the probability of a restrike is lower than when the circuit is at full operating current and voltage as when it is in the closed circuit position.

An Exemplary Tulip and Pin Contact Arrangement

Figure 2:
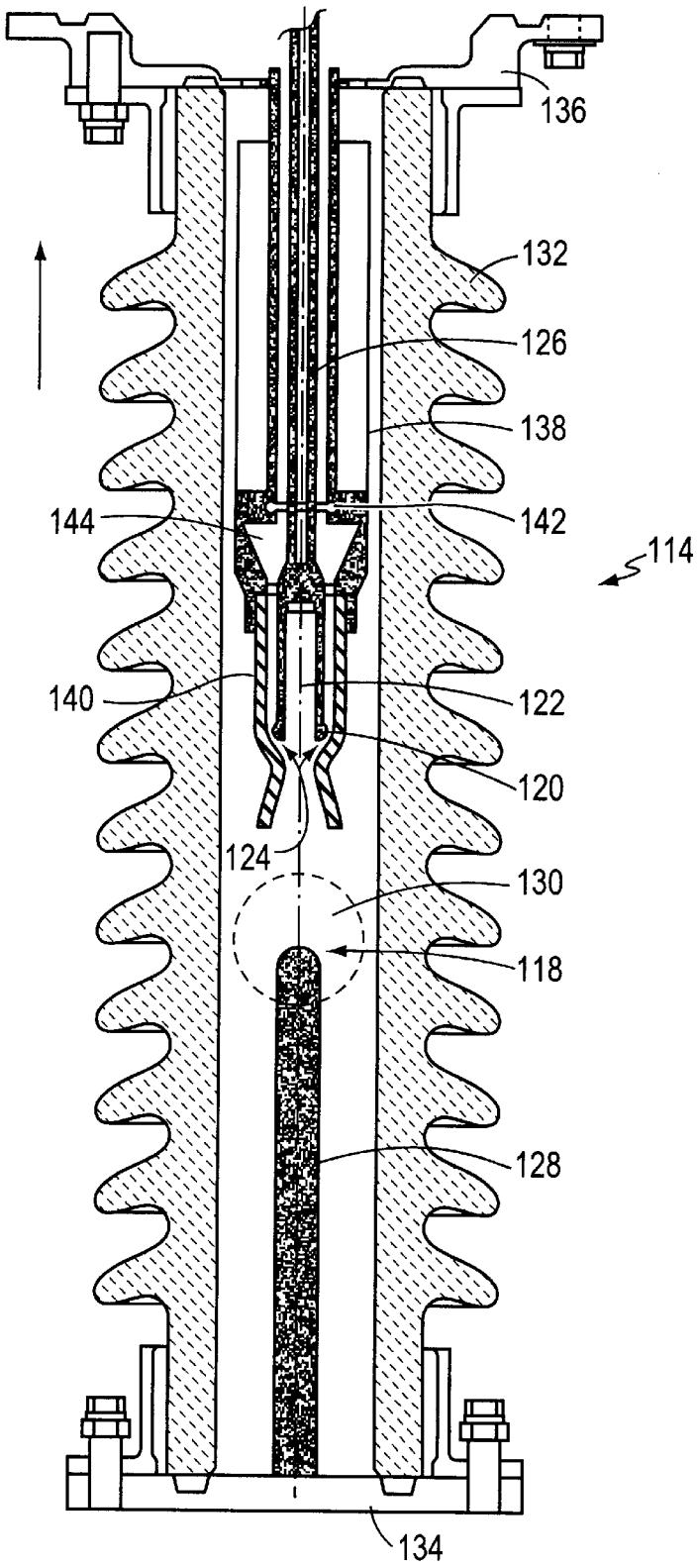
FIG. 2 illustrates an exemplary embodiment of the pin and tulip contacts of the present invention shown in a puffer-type circuit interrupter in the open circuit position.

Having described the structure and operation of an exemplary interrupter, the details of the interrupter's contacts will be described in more detail with reference to FIG. 2. FIG. 2 illustrates a cross section of the sealed interrupter chamber 114 in the open circuit position. The cross section of the interrupter is in most respects, symmetric about the longitudinal axis of the interrupter. The cross section shows a pin contact 118 and a tulip contact 120. In the closed circuit position (not shown), the tip of the pin contact 118 is located within the receiver 122 of the tulip contact 120. When the interrupter is moved from the open circuit position to the closed circuit position, the tulip contact 120 receives the pin contact 118 into the tulip contact's center receiver 122.

The tulip contact's center receiver 122 has several spring contactors 124 arranged annularly about the tulip contact's longitudinal axis. The spring contactors 124 are biased toward the longitudinal axis of the tulip contact 120. The spring contactors 124 establish a physical and electrical contact between the tulip contact 120 and the pin contact 118 when the interrupter is in the closed circuit position. The spring contactors 124 are spread apart as the pin contact 118 enters the tulip contact 120. The spring contactors 124 are spread apart when the surface of the pin contact 118 meets the inner surfaces of the spring contactors. As the pin contact 118 protrudes further into the tulip contact 120, the inner surfaces of the spring contactors slide along the outer surface of the pin contact 118.

The pin contact and tulip contact 120 reside within a sealed interrupter chamber 114 formed essentially by a chamber wall 132, a chamber base 134, and the spring housing 116 (FIG. 1*b*), which is connected to the chamber at a chamber cap 136. The sealed interrupter chamber 114 can be filled with an arc-extinguishing gas such as an admixture of helium gas and sulphur-hexaflouride ($SF_6$) gas. In the exemplary puffer-type interrupter depicted in FIG. 2, a plunger arrangement is typically utilized to open and close the circuit by bringing the pin contact 118 and the tulip contact 120 into and out of physical contact with each other. Gas flow may be achieved by the relative motion of a movable contact plunger 126 and a stationary contact structure 128. The plunger arrangement is confined within the sealed interrupter chamber 114, such that the movement of the contact plunger 126 with respect to the stationary contact structure 128 and the interrupter chamber controls the flow of the $SF_6$ gas across the arc gap 130.

As the interrupter transitions from the closed circuit position to the open circuit position, the contact plunger 126 is moved in the direction of the arrow in FIG. 2. The contact plunger 126 is attached to a piston cylinder 138 which has a nozzle 140 in which the tulip contact 120 is confined. As the contact plunger 126 is moved in the direction of the arrow, the piston cylinder 138 moves in relation to a stationary piston 142. The movement of the piston cylinder 138 in relation to the piston 142 forces the $SF_6$ gas through the piston chamber 144, through the nozzle 140, and across the tulip contact 120. When the tulip contact 120 is being separated from the pin contact 118, the nozzle 140 and the tulip contact 120 will be in the arc gap 130. Thus, the arc-extinguishing $SF_6$ gas will be forced across the arc gap 130 at the time at which the probability of a restrike is greatest. The nozzle shapes the flow of the $SF_6$ gas to direct the gas into the arc gap 130. Those skilled in the art will recognize that the arc-extinguishing effect of the $SF_6$ gas on the restrike is well known in the art.

As discussed above, the exemplary puffer-type interrupter 100 minimizes restrikes in three ways. First, it confines the restrike to the sealed interrupter chamber. Second, it provides for a flow of arc-extinguishing $SF_6$ gas across the arc gap during the period wherein the probability of restrike is greatest. Third, it provides for a high contact separation velocity. In an exemplary embodiment of the present invention, a pin contact is provided with a portion having an increased diameter operative to increase the separation velocity achievable by the interrupter. An exemplary embodiment of this pin contact will now be described in more detail.

An Exemplary Pin Contact

Figure 3:
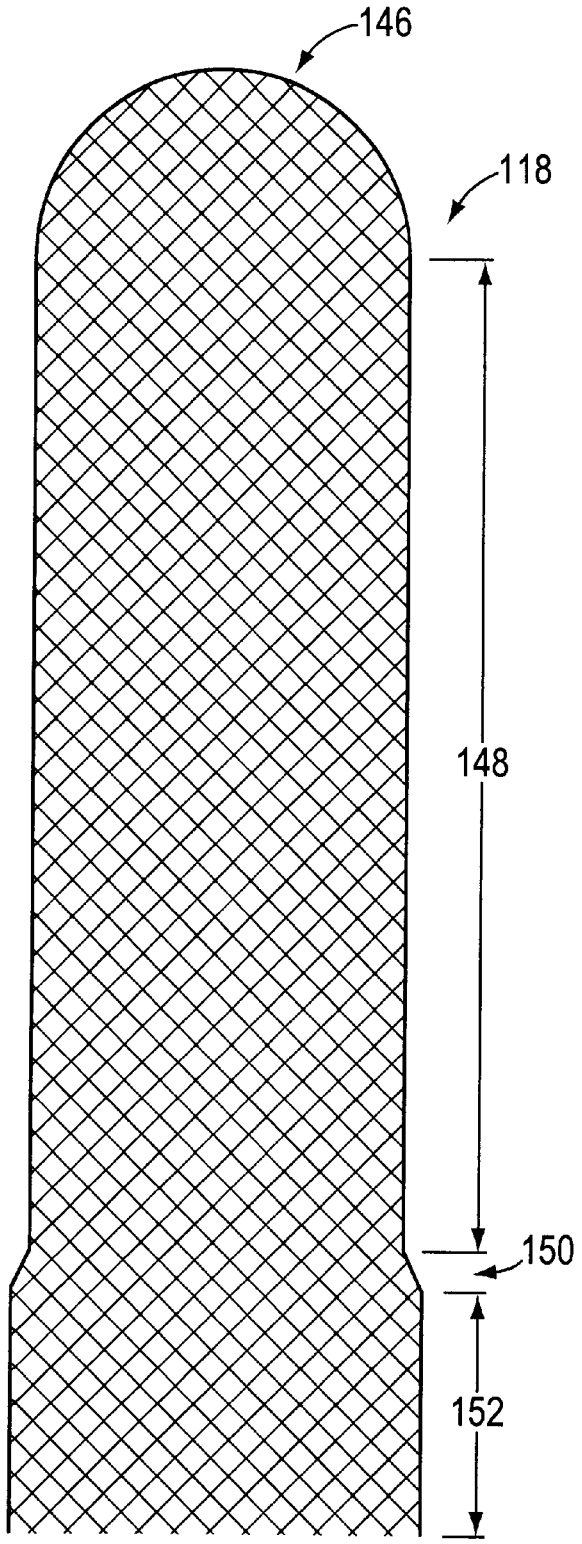
FIG. 3 illustrates an exemplary embodiment of the pin contact of the present invention.

Referring now to FIG. 3, an exemplary pin contact 118 is shown. The pin contact 118 is constructed of an electrically conductive material, such as copper, and is generally cylindrical with a hemispherical, or ellipsoid tip 146. The pin contact 118 is symmetric about its longitudinal axis.

The exemplary pin contact of FIG. 3 is divided into four portions: the tip portion 146, the elongate shaft portion 148, the transition portion 150, and the gripping portion 152. The gripping portion 152 has the greatest diameter of any other portion of the pin contact 118. The elongate shaft portion 148 has a greater diameter than any part of the tip portion 146. The transition portion 150 has a truncated conical shape that connects the diameters of the elongate shaft portion 148 and the gripping portion 152.

As the pin contact 118 and the tulip contact are connected, the tip portion 146 and elongate shaft portion 148 enter the receiver of the tulip contact 120 and slightly spread the spring contactors 124 of the tulip contact 120. Alternatively, the elongate shaft portion could have a slightly smaller diameter than the receiver, such that no physical contact is made with the spring contactors, even though the pin and tulip contacts are adjacent one another and in electrical contact. As the pin contact protrudes further into the receiver, the tulip contact's spring contactors 124 make contact with the transition portion 150 of the pin contact 118. The transition portion 150 operates to spread the spring contactors further apart, until they are opened to accommodate the greater diameter of the gripping portion 152. When the interrupter is in the closed circuit position, the tulip contact's spring contactors 124 are stationary and in contact with the gripping portion 152 of the pin contact 118.

The greater diameter of the gripping portion 152 of the pin contact 118 increases the static friction between the tulip contact 120 and the pin contact 118. The static friction is increased because the spring contactors 124 are spread so that the force exerted by the spring contactors 124 on the gripping portion of the pin contact 118 is greater than the force exerted by the spring contactors on the elongate shaft portion 148 of the pin contact 118. The higher static friction between the gripping portion 152 of the pin contact 118 and the spring contactors 124 requires a greater amount of force along the longitudinal axis of the pin contact 118 to separate the pin contact 118 and the tulip contact 120. Thus, the gripping portion 152 has a grip-enhancing element that provides resistance to separation of the pin and tulip contacts. In this case, the grip-enhancing element is the higher degree of static friction. In other embodiments described below in connection with FIGS. 4*a*–4*e*, other grip-enhancing elements may be used.

As discussed above, the separation of the pin contact 118 and the tulip contact 120 by the interrupter is provided by a spring arrangement. The spring arrangement is energized by the actuator arm's movement until a transition point is reach. After the transition point is reached, the spring converts its potential energy into kinetic energy and causes the separation of the pin contact 118 and the tulip contact 120 at a high velocity. The object is to separate the pin contact 118 and the tulip contact 120 to the point at which restrike is impossible within the shortest amount of time possible. In the interrupter that is an exemplary embodiment of the present invention, the speed of separation must be about 100 inches per second in order to adequately minimize the probability of a restrike. Unfortunately, there is only a short distance in which the tulip contact can be accelerated from a velocity of zero inches per second to a velocity of about 100 inches per second. Therefore, the potential energy of the spring arrangement should be maximized prior to the transition point in order to maximize the kinetic energy acting upon the contacts after the transition point.

The gripping portion 152 of the pin contact 118 provides the means by which the potential energy of the spring arrangement is maximized. By providing a portion of the pin contact 118 that increases the static friction between the tulip contact 120 and the pin contact 118 in the interrupter's closed circuit position, the exemplary interrupter keeps the contacts together for a longer portion of the disconnect procedure, thereby permitting the spring arrangement to build up more potential energy. When the transition point is finally reached, the contacts will separate at a higher speed than if the pin contact did not have the gripping portion 152 with its increased diameter.

Figure 4A:
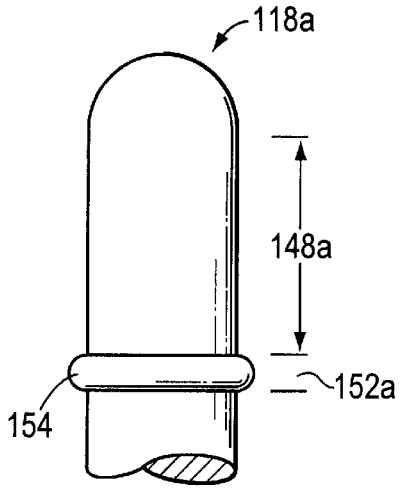
FIGS. 4*a*–4*e* illustrate alternative embodiments of the pin contact of the present invention

Referring now to FIGS. 4*a*–4*e*, various embodiments of the present invention are depicted. In FIG. 4*a*, an embodiment of the pin contact is shown with a gripping portion 152*a* having an annular ring 154 for providing separation resistance. In this embodiment, the female contact (not shown) has a spring-loaded member that engages with the annular ring 154, such that the annular ring holds the female contact in position. For example, the spring contactors of the embodiment described in connection with FIGS. 2 and 3 might be equipped with feet that conform to the surface of the annular ring 154. The feet may pass over the annular ring 154 and snap into place in the closed circuit position. Once in place, the spring contactors and the annular ring 154 will tend to stay engaged, such that a high degree of separation resistance results. As discussed above, a high separation resistance can be used to generate more potential energy in the separation mechanism in order to increase separation acceleration.

Figure 4B:
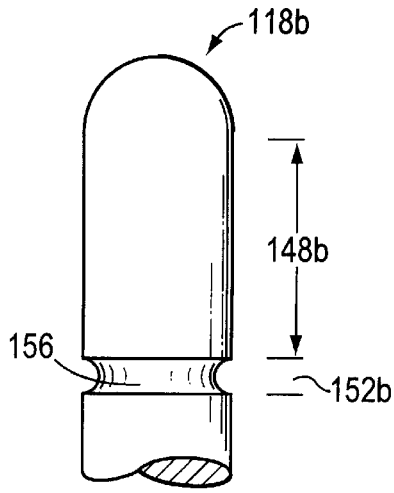

In FIG. 4*b,* an embodiment of the pin contact is shown with a gripping portion 152*b* having an annular groove 156 for providing separation resistance. In this embodiment, the female contact (not shown) has a spring-loaded member that engages with the annular groove 156, such that the annular groove holds the female contact in position. For example, the spring contactors of the embodiment described in connection with FIGS. 2 and 3 might be equipped with feet that conform to the surface of the annular groove 156. The feet may pass over the annular groove 156 and snap into place in the closed circuit position. Once in place, the spring contactors and the annular groove 156 will tend to stay engaged, such that a high degree of separation resistance results.

Figure 4C:
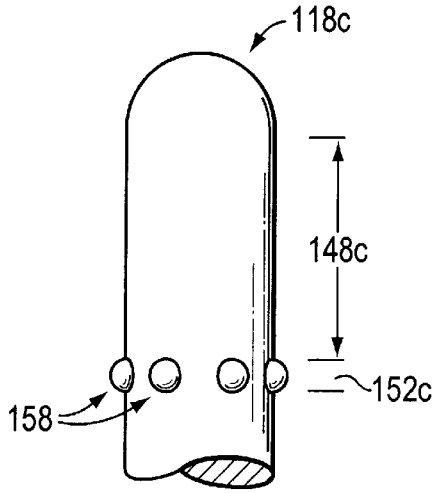

In FIG. 4*c,* an embodiment of the pin contact is shown with a gripping portion 152*c* having an annular row of raised knobs 158 for providing separation resistance. In this embodiment, the female contact (not shown) has a spring-loaded member that engages with the raised knobs 158, such that the raised knobs hold the female contact in position. For example, the spring contactors of the embodiment described in connection with FIGS. 2 and 3 might be equipped with feet that conform to the outer surface of the raised knobs 158. The feet may pass over the raised knobs 158 and snap into place in the closed circuit position. Once in place, the spring contactors and the raised knobs 158 will tend to stay engaged, such that a high degree of separation resistance results.

Figure 4D:
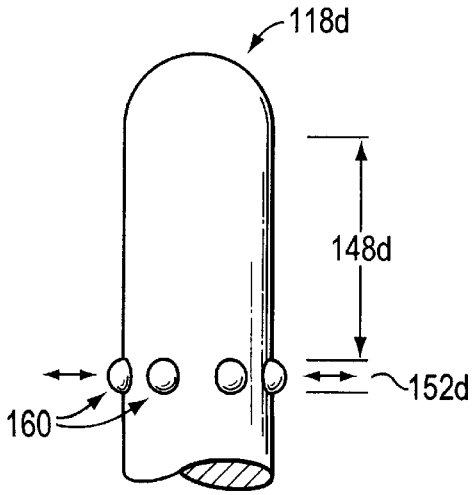

In FIG. 4*d,* an embodiment of the pin contact is shown with a gripping portion 152*d* having an annular row of spring-loaded bearings 160 for providing separation resistance. In this embodiment, the female contact (not shown) has conforming member that engages with the spring-loaded bearings 160, such that the spring-loaded bearings hold the female contact in position. For example, the conforming member may be an annular groove on the interior surface of the female contact, wherein the annular groove conforms to the outer surface of the spring-loaded bearings 160. The annular groove may pass over the spring-loaded bearings 160 and snap into place in the closed circuit position. Once in place, the annular groove and the spring-loaded bearings 160 will tend to stay engaged, such that a high degree of separation resistance results.

Figure 4E:
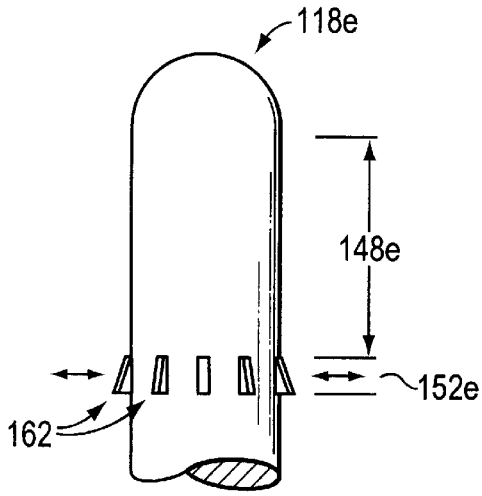

In FIG. 4*e,* an embodiment of the pin contact is shown with a gripping portion 152*e* having an annular row of spring clips 162 for providing separation resistance. In this embodiment, the female contact (not shown) has conforming member that engages with the spring clips 162, such that the spring clips hold the female contact in position. For example, the conforming member may be an annular groove on the interior surface of the female contact, wherein the annular groove conforms to the outer surface of the spring clips 162. The annular groove may pass over the spring clips 162 and snap into place in the closed circuit position. Once in place, the annular groove and the spring clips 162 will tend to stay engaged, such that a high degree of separation resistance results.

Those skilled in the art will appreciate that various structures, besides those described, can be utilized for the pin and tulip contacts. It will also be appreciated that the exemplary pin contact described above is not limited to a four-portion structure as described, but could be constructed with more than one transition portion in order to accommodate various tulip contact sizes or to provide a more subtle transition to larger diameters. Although the transition portion has been described herein as having a truncated conical shape, it will be understood that the inventor contemplates that transition portions with various shapes can be implemented to practice the present invention. Additionally, it is contemplated that the pin contact and tulip contact of the present invention are not limited to cylindrical structures, but could be virtually any shape. For example, the pin contact could have a square or rectangular cross section with a corresponding tulip contact having an inside dimension conforming to the pin contact's cross sectional shape.

While the present invention is susceptible to various modifications and alternative forms, an exemplary embodiment has been depicted by way of example in the drawings and in the detailed description. It should be understood, however, that it is not intended to limit the scope of the present invention to the particular embodiments described. On the contrary, the intention is to cover all modifications, equivalents, and alternatives falling within the spirit and scope of the invention as defined by the appended claims.

The invention claimed is:

1. A male contact configured for removable engagement with a receiver of a female contact, comprising:

a gripping portion configured to cause a relatively high tension engagement with the receiver of the female contact when the gripping portion is in contact with the receiver;

an elongate shaft portion connected to the gripping portion and configured to cause a relatively low tension engagement with the receiver of the female contact when the elongate shaft portion is adjacent to the receiver;

the gripping portion and the elongate shaft portion of the male contact configured to maintain electrical conduction with the receiver when the male and female contacts are energized within an intended high voltage range, the electrical conduction maintaining as the male and female contacts slide past each other in an opening stroke until the male and female contacts define an arc gap;

the male and female contacts configured to extinguish the electrical conduction at the arc gap during the opening stroke; and the male and female contacts configured to extinguish the electrical conduction for multiple opening strokes without substantially physically degrading the male or female contacts.

2. The male contact of claim 1, wherein:

the elongate shaft portion defines a first outer profile; and the receiver of the female contact defines a resilient aperture that substantially conforms to the first outer profile when the resilient aperture is in an unstressed condition.

3. The male contact of claim 2, wherein:

the gripping portion defines a second outer profile; and the resilient aperture substantially conforms to the second outer profile when the resilient aperture is in a stressed condition caused by receipt of the gripping portion within the aperture.

4. The male contact of claim 3, wherein:

the first outer profile comprises a substantially cylindrical surface with a first diameter; and the second outer profile comprises a substantially cylindrical surface with a second diameter that is greater than the first diameter.

5. The male contact of claim 4, further comprising a hemispherical tip.

6. The male contact of claim 1, wherein the receiver of the female contact defines a tulip shape comprising a plurality of spring contactors.

7. The male contact of claim 1, wherein the gripping portion comprises a grip-enhancing element positioned for engagement with receiver of the female contact when the male and female contacts are in a closed position, the grip-enhancing element selected from the group comprising:

a raised annular rib around the male contact;

an inset annular groove around the male contact;

a raised knob;

a plurality of raised knobs defining a continual ring around the male contact;

a partially inset spring-loaded bearing;

a plurality of partially inset spring-loaded bearings defining a continual ring around the male contact;

a spring clip; and a plurality of spring clips.

8. A penetrating electrical contact comprising:

a female contact defining a receiver;

a male contact configured for removable engagement with the receiver and including, a gripping portion configured to cause a relatively high tension engagement with the receiver of the female contact when the gripping portion is in contact with the receiver, and an elongate shaft portion connected to the gripping portion and configured to cause a relatively low or no tension engagement with the receiver of the female contact when the shaft is adjacent to the receiver;

the gripping portion and the elongate shaft portion of the male contact configured to maintain electrical conduction with the receiver when the male and female contacts are energized within an intended high voltage range, the electrical conduction maintaining as the male and female contacts slide past each other in an opening stroke until the male and female contacts define an arc gap;

the male and female contacts configured to extinguish the electrical conduction at the arc gap during the opening stroke; and the male and female contacts configured to extinguish the electrical conduction for multiple opening strokes without substantially physically degrading the male or female contacts.

9. The penetrating electrical contact of claim 8, wherein:

the elongate shaft portion of the male contact defines a first outer profile; and the receiver of the female contact defines a resilient aperture that substantially conforms to the first outer profile when the resilient aperture is in an unstressed condition.

10. The penetrating electrical contact of claim 9, wherein:

the gripping portion of the male contact defines a second outer profile; and the resilient aperture of the female contact substantially conforms to the second outer profile when the resilient aperture is in a stressed condition caused by receipt of the gripping portion within the aperture.

11. The penetrating electrical contact of claim 10, wherein:

the first outer profile of the male contact comprises a substantially cylindrical surface with a first diameter; and the second outer profile of the male contact comprises a substantially cylindrical surface with a second diameter that is greater than the first diameter.

12. The penetrating electrical contact of claim 11, wherein the male contact further comprises a hemispherical tip.

13. The penetrating electrical contact of claim 12, wherein the receiver of the female contact defines a tulip shape comprising a plurality of spring contactors.

14. The penetrating electrical contact of claim 8, wherein the gripping portion of the male contact comprises a grip-enhancing element positioned for engagement with receiver of the female contact when the male and female contacts are in a closed position, the grip-enhancing element selected from the group comprising:

a raised annular rib around the male contact;

an inset annular groove around the male contact;

a raised knob;

a plurality of raised knobs defining a continual ring around the male contact;

a partially inset spring-loaded bearing;

a plurality of partially inset spring-loaded bearings defining a continual ring around the male contact;

a spring clip;

a plurality of spring clips defining a continual ring around the male contact.

15. A interrupter switch for an electric power line, comprising:

a penetrating electrical contact including:

a female contact defining a receiver;

a male contact configured for removable engagement with the receiver and including, a gripping portion configured to cause a relatively high tension engagement with the receiver of the female contact when the gripping portion is in contact with the receiver, and an elongate shaft portion connected to the gripping portion and configured to cause a relatively low or no tension engagement with the receiver of the female contact when the elongate shaft portion is adjacent to the receiver;

the gripping portion and the elongate shaft portion of the male contact configured to maintain electrical conduction with the receiver when the male and female contacts are energized within an intended high voltage range, the electrical conduction maintaining as the male and female contacts slide past each other in an opening stroke until the male and female contacts define an arc gap;

the male and female contacts configured to extinguish the electrical conduction at the arc gap during the opening stroke;

the male and female contacts configured to extinguish the electrical conduction for multiple opening strokes without substantially physically degrading the male or female contacts;

a separation mechanism operative to move the male contact and the female contact through the opening stroke to an open circuit position and to move the male contact and the female contact through a closing stroke to a closed circuit position.

16. The interrupter switch of claim 15, wherein the electrical conduction extinguishing configuration of the male and female contacts comprises a separation resistance resulting from the relatively high tension engagement.

17. The interrupter switch of claim 15, wherein the interrupter switch further comprises:

a separation mechanism; and wherein the separation mechanism is operative to separate the male and female contacts at a separation acceleration.

18. The interrupter switch of claim 17, wherein the separation acceleration is sufficient to prohibit the occurrence of a restrike between the male contact and the female contact as the male contact and the female contact are moved through the arc gap.

19. The interrupter switch of claim 18, wherein the separation acceleration is capable of separating the male contact and the female contact at a velocity of about 100 inches per second when the arc gap is no more than approximately 1.5 inches in length along a longitudinal axis of the male contact.

* * * * *